US005365979A

United States Patent [19]

Yoshida

[11] Patent Number: 5,365,979

[45] Date of Patent: Nov. 22, 1994

[54] DOBBY FOR ELECTROMAGNETICALLY CONTROLLING A HEALD FRAME

[75] Inventor: Fumio Yoshida, Iwakura, Japan

[73] Assignee: Kabushiki Kaisha Yamada Dobby, Bisai, Japan

[21] Appl. No.: 34,558

[22] Filed: Mar. 19, 1993

[30] Foreign Application Priority Data

Dec. 25, 1992 [JP] Japan ..... 4-357921

[51] Int. Cl.[5] ..... D03C 1/06

[52] U.S. Cl. ..... 139/66 R; 139/68; 139/71; 139/455

[58] Field of Search ..... 139/66 R, 71, 68, 455

[56] References Cited

U.S. PATENT DOCUMENTS 4,461,325 7/1984 Palau et al. ..... 139/66 R
4,465,107 8/1984 Epis ..... 139/66 R
4,474,221 10/1984 Mizuguchi .
5,018,556 5/1991 Yoshida et al. ..... 139/68

FOREIGN PATENT DOCUMENTS 0034045 8/1981 European Pat. Off. .
0200123 12/1986 European Pat. Off. .
0418177 2/1991 European Pat. Off. .
3910487 10/1989 Germany .
2-23611 5/1990 Japan ..... D03C 1/00
3-004658 of 1991 Japan .
3-04658 1/1991 Japan ..... D03C 1/26

OTHER PUBLICATIONS

English Abstract for U.S. Patent No. 5,070,911 related to DE 3,910,487.
English Abstract for U.S. Patent No. 5,018,556 related to EP 0,418,177.

*Primary Examiner*—Andrew M. Falik
*Attorney, Agent, or Firm*—Webb Ziesenheim Bruening Logsdon Orkin & Hanson

[57] ABSTRACT

A dobby comprises first and second hooks relatively moved in the direction of approaching and leaving each other, a lever for selectively forcing the second hook to be engaged with the first hook, and a pusher for selectively providing the force to the lever. One of the lever and the pusher has a cam-shaped contact face brought into contact with the other of the lever and the pusher.

17 Claims, 5 Drawing Sheets

DOBBY FOR ELECTROMAGNETICALLY CONTROLLING A HEALD FRAME

BACKGROUND OF THE INVENTION

1. Field of the Invention

This invention relates to a dobby used in weaving by a weaving machine, and more particularly, to a dobby for electromagnetically controlling a heald frame to be moved upwards or downwards.

2. Description of the Prior Art

A dobby for electromagnetically controlling a heald frame to be moved upwards or downwards generally comprises a plurality of working mechanisms each including a vertical lever connected to the heald frame: a pair of connection hooks pivotally attached to the vertical lever; a pair of knife hooks periodically moved reversely to each other in the direction of approaching and leaving the connection hooks; a pair of rockable command levers for controlling the knife hooks to selectively displace to a first position where the knife hooks cannot be engaged with the connection hooks and to a second position where the knife hooks can be engaged with the connection hooks; a rockable pusher for controlling the position of the command lever; a rockable selection lever for displacing the command lever so as to selectively displace the knife hooks to the first and second positions; and an electromagnet for releasably holding the selection lever so as to selectively displace the knife hooks to the first and second positions (Japanese Pat. Publication Nos. 2-23611 and 3-4658).

In a dobby known per se, one or more heald frames are connected to the vertical lever in each working mechanism through a link mechanism or the like. When the selection lever is not held on the magnet, the pusher is maintained at the position where the pusher is out of contact with the command lever so that the knife hooks are maintained at the first position where the knife hooks cannot be engaged with the connection hooks. On the other hand, when the selection lever is held on the magnet, the pusher is maintained at the position where the pusher can be in contact with the command lever and under this condition the pusher is rocked to push the command lever so that the knife hooks are maintained at the second position where the knife hooks can be engaged with the connection hooks.

Since the vertical lever is not moved even though the knife hooks are moved while they are not engaged with the connection hooks, one or more heald frames connected to the vertical lever are not moved. However, if the knife hooks are moved while they are engaged with the connection hooks, the vertical lever is moved in one direction, so that one or more heald frames connected to the vertical lever are moved.

In the dobby known per se, however, the pusher is usually made apart from the command lever. Therefore, when the knife hooks are engaged with the connection hooks, the pusher is moved in the vertical direction with the selection lever held on the magnet, so that the pusher collides with the command lever. Therefore, in the dobby known per se, the impact when the pusher collides with the command lever is large and in some cases, the selection lever held on the magnet is separated from the magnet.

Particularly, in the dobby provided with a spring which allows a force for separating the selection lever from the magnet to be applied to the selection lever, the selection lever is often separated from the magnet by the impact when the pusher collides with the command lever. In this manner, when the selection lever held on the magnet is separated from the magnet, the knife hooks are not correctly engaged with the connection hooks and therefore, the heald frame is not correctly moved, resulting in mis-weaving.

SUMMARY OF THE INVENTION

An object of the present invention is to prevent a lever, which is held on a magnet, from separating from the magnet in accordance with the movement of a pusher, thereby preventing mis-weaving.

A dobby of the present invention comprises first and second hooks with means for moving at least one of said first and second hooks in the direction of approaching and leaving each other, the first hook being connected to a heald frame and the second hook being pivotally movable to a first position where the second hook cannot be engaged with the first hook and to a second position where the second hook can be engaged with the first hook; a first lever selectively displaceable to a third position for controlling the second hook to be displaced to the first position and to a fourth position for controlling the second hook to be pivotally displaced to the second position; a pusher selectively displaceable to a fifth position for controlling the first lever to be displaced to the third position and to a sixth position for controlling the first lever to be displaced to the fourth position; a second lever for selectively displacing the pusher to the fifth and sixth positions; and a magnet for releasably holding the second lever so as to maintain the pusher at either of the fifth and sixth positions. One of the first lever and the pusher has a cam-shaped contact face brought into contact with a portion of the other of the first lever and the pusher.

In the dobby of the present invention, one or more heald frames are connected to the first hook through a link mechanism or the like. When the second lever is not held on the magnet, the pusher is maintained at either of the fifth and sixth positions so that the second hook is maintained at either of the first position where the second hook cannot be engaged with the first hook or the second position where the second hook can be engaged with the first hook. On the other hand, when the second lever is held on the magnet, the pusher and the second hook are maintained at the other positions, respectively.

For this reason, when the first or second hook is moved relative to the second or first hook under the condition that the pusher is maintained at the fifth position, the second hook is not engaged with the first hook. Therefore, the first lever is not moved, and one or more heald frames connected to the first hook are not moved.

When the pusher is displaced from the fifth position to the sixth position, the first lever is displaced from the third position to the fourth position. Accordingly, the second hook is displaced from the first position to the second position.

Since the second hook is engaged with the first hook when the second hook is moved under the condition that the pusher is maintained at the sixth position, the first hook is moved together with the second hook, and one or more heald frames connected to the first hook are moved.

When the pusher is displaced from the fifth position to the sixth position or when it is reversely displaced, the first lever is pushed by the pusher.

According to the present invention, since one of the first lever and the pusher has a cam-shaped contact face brought into contact with a portion of the other of the first lever and the pusher, the relative movement of the first lever and the pusher in correspondence to the positional displacement of the pusher is smooth, and an impact accompanied by the positional displacement becomes small. As a result, the second lever which is held on the magnet is prevented from separating from the magnet in accordance with the positional displacement of the pusher, thereby preventing mis-weaving.

The contact face described above preferably has flat first and second faces, and an inclined third face extending between the first and second faces so as to be continuous with the first and second faces. By so doing, since a contact point between the first lever and the pusher is moved along the cam-shaped contact face in correspondence to the positional displacement of the pusher, the relative movement of the first lever and the pusher becomes smoother and the impact accompanied by the positional displacement of the pusher becomes smaller. As a result, the detachment of the second lever from the magnet can be surely prevented, so that mis-weaving can also be surely prevented.

It is preferable that a line for connecting a contact portion between the first lever and the pusher to the rocking motion center of the first lever be made perpendicular to a line for connecting the contact portion between the first lever and the pusher to the rocking motion center of the pusher. By so doing, since the contact point between the first lever and the pusher is moved in correspondence to the positional displacement, the relative movement of the first lever and the pusher becomes further smoother, and the impact accompanied by the positional displacement of the pusher becomes further smaller. As a result, the detachment of the second lever from the magnet can be surely prevented, so that mis-weaving can also be surely prevented.

In a preferred embodiment, when the second lever is held on the magnet, the pusher is maintained at the sixth position.

Further, it is preferable to comprise an elastic body for applying a force, which allows the pusher to be displaced to the other of the fifth and sixth positions, to the second lever. By so doing, when the magnet is set under non-excited state, the second lever is surely displaced to a predetermined position by a third elastic body.

In a preferred embodiment, the first hook can be reciprocated in the direction of approaching and leaving the second hook, whereas the second hook can be reciprocated periodically in the direction of approaching and leaving the first hook.

Furthermore, in the preferred embodiment described above, it is preferable to comprise a first elastic body for applying a force, which allows the second hook to be displaced to one of the first and second positions, to the second hook, and a second elastic body for applying a force, which allows the first lever to be displaced to the third position, to the first lever. By so doing, since the first lever and the pusher are always brought into contact with each other by the second elastic body, the impact accompanied by the positional displacement of the pusher is almost reduced to zero. As a result, the detachment of the second lever from the magnet can be more surely prevented, so that mis-weaving can also be more surely prevented.

In another preferred embodiment, the first hook is reciprocated periodically in the direction of approaching and leaving the second hook, whereas the second hook cannot be moved in the direction of approaching and leaving the first hook.

In another preferred embodiment described above, the first lever is fixed to the second hook. Furthermore, it includes an elastic body for applying a force, which allows the second hook to be displaced to one of the first and second positions, to the second hook.

In any of the preferred embodiments, it comprises a pair of the first hooks pivotally attached to the rockable third lever and provided at the opposite position with respect to the rocking center of the third lever; a pair of the second hooks corresponding to the first hooks individually and engaged with the corresponding first hooks; and a pair of the first levers corresponding to the second hooks individually and controlling the corresponding second hooks, and the pusher controls both of the first levers.

Furthermore, it is preferable to comprise drive means for periodically moving the second lever toward the magnet in synchronization with the rotation of the main shaft in a weaving machine, while moving the second lever toward the magnet at the start times of the reverse and normal rotations of the main shaft in the weaving machine.

In this way, the magnet is set in an excited state in accordance with a weaving pattern in synchronization with the rotation of the weaving machine during the normal and reverse rotations, and the second lever approaches or is brought into contact with the magnet periodically by the drive means. Therefore, the second lever is surely held on the magnet even by using a magnet with a small holding force. As a result, the holding force of the magnet can be prevented from giving any influences on the other second lever, and the heald frame can be moved correctly.

Since the second lever is moved toward the magnet at the start time of the reverse rotation and subsequently at the restart time of the normal rotation for treating the mis-weaving or the like, the reverse and normal rotations are started under the correct condition that the second lever corresponds to a weaving pattern thereof. As a result, a warp is provided under the correct shedding condition corresponding to the weaving pattern at the start times of the reverse and normal rotations, and therefore, the forbidden band against the reverse rotation and that against the normal rotation can be minimized depending on work errors or the like.

In the preferred embodiments, the drive means includes a first drive mechanism for periodically moving the second lever toward the magnet in synchronization with the rotation of the main shaft in a weaving machine; and a second drive mechanism for moving the second lever toward the magnet at the start times of the reverse and normal rotations of the main shaft in the weaving machine.

BRIEF DESCRIPTION OF THE DRAWINGS

The foregoing and other objects and features of the invention will become apparent from the following description of preferred embodiments of the invention with reference to the accompanying drawings, in which:

FIG. 4 is a time chart for explaining the operation of the dobby;

Sub

DETAILED DESCRIPTION OF THE PREFERRED EMBODIMENTS

Figure 1:
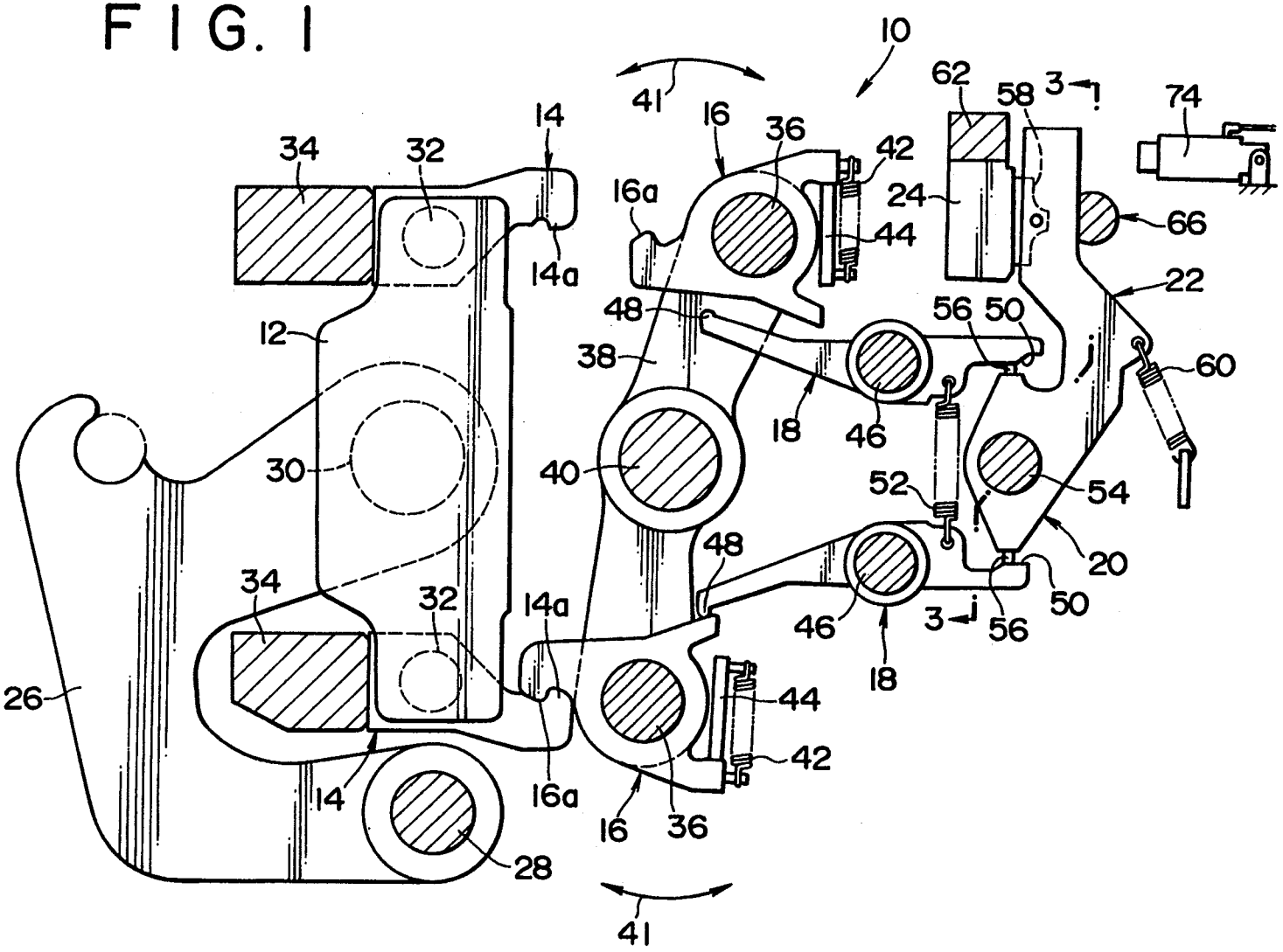
FIG. 1 is a side view showing a dobby as a preferred embodiment of the present invention.

Referring now to FIG. 1, a dobby comprises a working mechanism 10 corresponding to one or more heald frames (not shown), respectively.

Each working mechanism 10 comprises: a vertical lever 12 extending in the vertical direction; first hooks or connection hooks 14 pivotally attached respectively to a pair of portions at an interval in the longitudinal direction of the vertical lever; second hooks or knife hooks 16 corresponding to the connection hooks respectively; command levers 18 corresponding to the knife hooks respectively; a pusher 20 for displacing the command levers; a second lever or selection lever 22 for displacing the pusher; and a magnet 24 for releasably holding the selection lever 22.

The vertical lever 12 is connected to corresponding one or more heald frames through a link mechanism such as a jack lever 26. The jack lever 26 has a C-shape. One end of the jack lever 26 is rockably supported by a shaft 28 extending in the horizontal direction, and the other end of the jack lever 26 is rockably connected to the center of the vertical lever 12 by a pivot 30 in parallel with the shaft 28. The shaft 28 extends perpendicularly to the paper in FIG. 1.

Each connection hook 14 is rockably attached to the end of the vertical lever 12 by a pivot 32 in parallel with the shaft 28 and has a hook portion 14*a*, which can be engaged with the knife hook 16, at a top end thereof. The rear end face of each connection hook 14 is brought into contact with a stopper 34 in parallel with the shaft 28 by drawing the jack lever 26 and the vertical lever 12 to the left in FIG. 1 by springs (not shown) connected to the corresponding heald frames. Each connection hook 14 is prevented from the rockable motion around an axis of the pivot 32, while the rear end face thereof is brought into contact with the stopper 34.

Each second hook 16 is provided at the end of a rocking lever 38, which extends in the vertical direction, rockably by a pivot 36 in parallel with the shaft 28. The rocking lever 38 is supported by a rockable shaft 40, which extends in parallel with the shaft 28, in the center thereof. Each knife hook 16 has a hook portion 16*a* which can be engaged with the hook portion 14*a* of the corresponding connection hook 14, and the hook portion 16*a* is biased by an elastic body 42 at a position where the hook portion 16*a* can be engaged with the hook portion 14*a*.

The shaft 40 is periodically rotated normally or reversely within a predetermined angular range in synchronization with the rotation of the main shaft in a weaving machine and allows the rocking lever 38 to be rocked in the direction indicated by an arrow 41 in FIG. 1 in synchronization with the rotation of the main shaft in the weaving machine. Accordingly, both of the knife hooks 16 are periodically moved alternately and mutually reversely in the direction of approaching and leaving the connection hooks 14 in synchronization with the rotation of the main shaft in the weaving machine.

In the illustrated embodiment, each elastic body 42 is anchored to both of the knife hook 16 and a stopper 44 for preventing the knife hook 16 from rotating at an angle greater than a predetermined angle. The stopper 44 is fixed on a rocking lever 38 or the knife hook 16. In the illustrated embodiment, the elastic body 42 is provided at each knife hook 16. However, one elastic body may be used in common to both knife hooks.

The command levers 18 are rockably supported by a pivot 46 extending in parallel with the shaft 28 and is disposed so as to face each other in the vertical direction and to extend in the horizontal direction. The command lever 18 has a push portion 48 for pushing the corresponding knife hook 16 at one end thereof and also has a so-called cam-shaped contact face 50 brought into contact with a pusher 20 on the internal side of the other end thereof. The command lever 18 is biased by an elastic body 52 in the direction of the pusher 20 so that the contact faces 50 approach each other, and the command lever 18 is pushed against the pusher 20.

Figure 2:
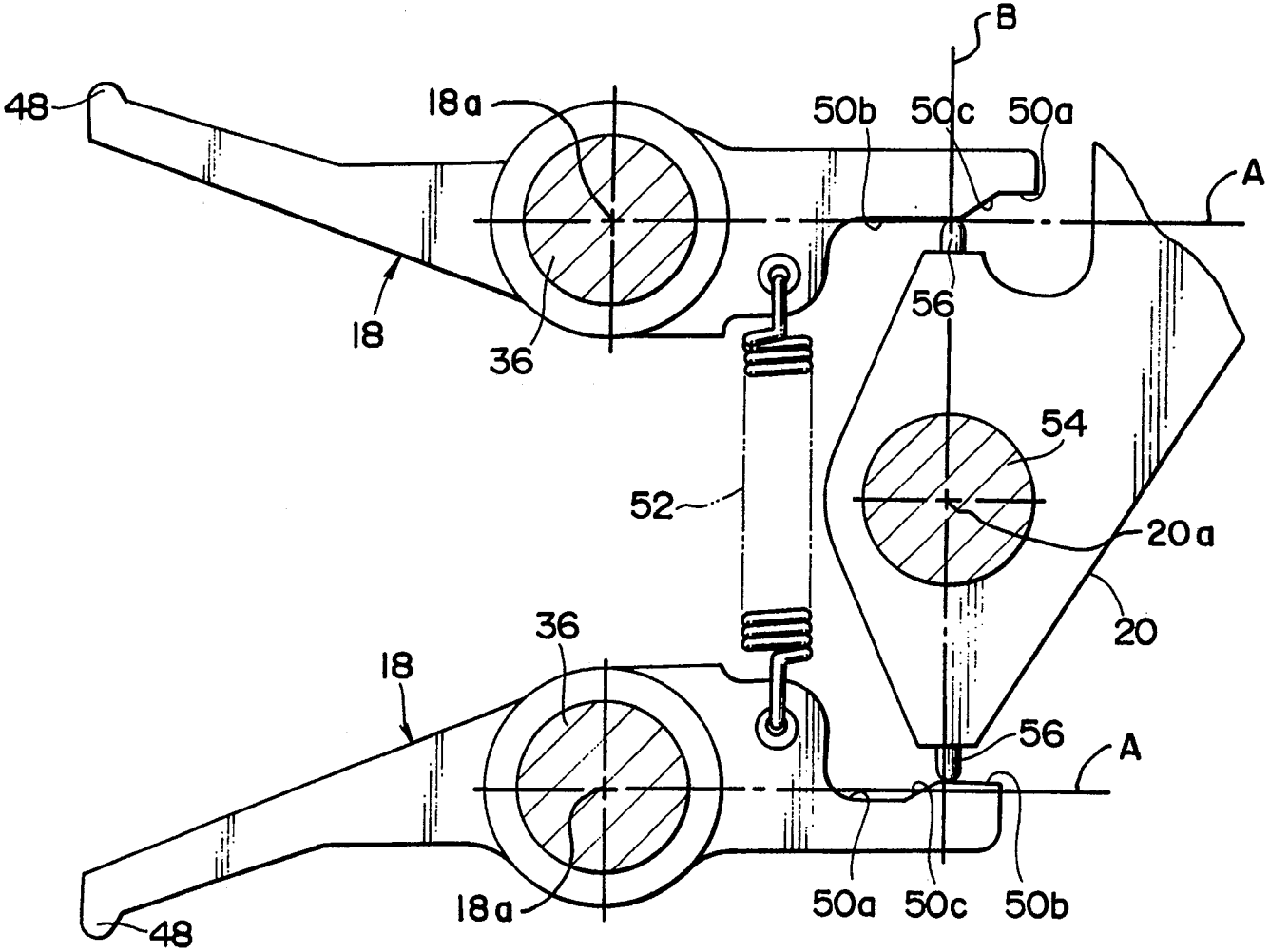
FIG. 2 is an enlarged-scale view showing the neighborhood of a command lever in the dobby shown in FIG. 1.

As shown in FIG. 2, each contact face 50 has flat first and second faces 50*a* and 50*b* located at an interval in the horizontal direction and extending in the horizontal direction at the position with a different height, and an inclined third face 50*c* extending between the first and second faces so as to be continuous with the first and second faces. Both contact faces 50 are opposite to each other and formed in the reverse direction to each other. However, the contact faces 50 may be a cam face having another shape as well.

The pusher 20 is provided between both contact faces 50 and rockably supported by a pivot 54 extending in parallel with the shaft 28 between both contact faces 50. The pusher 20 has contact portions 56 brought into contact with the contact faces 50 of both vertical ends of a main body thereof, respectively.

In the illustrated embodiment, each contact portion 56 is a projection portion projecting toward the contact face 50, and a point end face thereof is formed into a spherical or circular face. Instead of using the projection portion as the contact portion 56, a spherical or roller-shaped member may also be provided rotatably and unremovably in the main body of the pusher 20. Each contact faces 50 may be provided on the pusher 20, and each contact portion 56 may also be provided on the command lever 18.

The selection lever 22 is installed in the pusher 20 and extends from the side portion of the pusher 20. An actuating piece 58 held on the magnet 24 is mounted on the top end of the selection lever 22. The selection lever 22 is biased by an elastic body 60 in the direction of separating the actuating piece 58 from the magnet 24. The magnet 24 is made of an electromagnet and mounted on a support member 62 in parallel with the shaft 28. The extending direction of the selection lever 22 can be an arbitrary direction such as upward or sideward.

In the illustrated embodiment, tensile coil springs are used as the elastic bodies 42, 52 and 60, but other elastic bodies such as compression coil springs and elastic bands may be used as well. The shafts 28 and 40 and the pivots 46 and 54 are also supported by a frame 64 (refer to FIG. 3) of the dobby. The shafts 28 and 40, the pivots 46 and 54 and the support member 62 are used in common for all or some working mechanisms 10, but they may also be provided at each working mechanism 10.

When the selection lever 22 is displaced by a force of the elastic body 60 to the position where the actuating piece 58 is separated from the magnet 24, the pusher 20 is displaced to the position where the contact portion 56 is brought into contact with a step portion 50*a* of the command lever 18. Therefore, the command lever 18 is displaced to the position, where the push portion 48 pushes each knife hook 16, against the force from the elastic body 42 by the force of the elastic body 52, and each knife hook 16 is displaced to the position where each knife hook 16 cannot be engaged with each connection hook 14.

When the selection lever 22 is displaced against the force of the elastic body 60 to the position where the actuating piece 58 is brought into contact with the magnet 24, the pusher 20 is displaced to the position where the contact portion 56 is brought into contact with the second face 50*b* of the command lever 18. Therefore, the command lever 18 is displaced against the force of the elastic body 52 to the position where the push portion 48 is separated from each knife hook 16, and each knife hook 16 is displaced by the elastic body 42 to the position where each knife hook 16 can be engaged with each connection hook 14.

When the rocking lever 38 is rocked under the condition that the selection lever 22 is displaced to the position where the actuating piece 58 is separated from the magnet 24, the knife hooks 16 are moved in the mutual reverse direction, while the connection hooks 14, the vertical lever 12 and the jack lever 26 are not displaced.

On the other hand, when the rocking lever 38 is rocked under the condition that the selection lever 22 is displaced to the position where the actuating piece 58 is brought into contact with the magnet 24, the knife hook 16 is engaged with the connection hook 14 at the time when the knife hook 16 is moved to the leftmost position in FIG. 1, that is, when the knife hook 16 gets closest to the connection hook 14. Further, when the knife hook 16 is moved to the rightmost position in FIG. 1 in the engagement condition, the connection hook 14 is moved in the same direction. Thus, the vertical lever 12 and the jack lever 26 are both rocked so that the pivot 30 may be drawn to the right in FIG. 1.

When one connection hook 14 is drawn to the right in FIG. 1 and unless the other connection hook 14 is engaged with the corresponding knife hook 16, one connection hook 14 is drawn closer under the condition that the other connection hook 14 is brought into contact with the stopper 34. Therefore, the vertical lever 12 is drawn closer by using the other connection hook 14 as a supporting point so that the position of the pivot 30 is moved to the right in FIG. 1. In this manner, one or more heald frames connected to the jack lever 26 are moved upwards.

On the other hand, when one connection hook 14 is drawn to the right in FIG. 1 and if the other connection hook 14 is drawn to the right in FIG. 1, one connection hook 14 is drawn to the right in FIG. 1, whereas the other connection hook 14 is moved to the left in FIG. 1 together with the knife hook 16 engaged with the other connection hook. That is, both of the connection hooks 14 are moved in the direction reverse to each other. Therefore, the vertical lever 12 is rocked around the pivot 30 with little changes in the position of the pivot 30, and as a result, one or more heald frames connected to the jack lever 26 are maintained in the raised state.

When the contact face 50 is formed into a cam-shaped face as shown in the case of the working mechanism 10, the relative movement of the command lever 18 and the pusher 20 in accordance with the positional displacement of the pusher 20 becomes smooth, and the impact accompanied by the positional displacement of the pusher 20 becomes small. As a result, the actuating piece 58 held on the magnet 24 is prevented from being separated from the magnet 24 accompanied with the positional displacement of the pusher 20, so that mis-weaving is prevented.

In the working mechanism 10, a line A for connecting the contact portion between the command lever 18 and the pusher 20 to the rocking motion center 18*a* of each command lever 18 is perpendicular to a line B for connecting the contact portion between the command lever 18 and the pusher 20 to the rocking motion center 20*a* of the pusher 20. Accordingly, the contact point between the command lever 18 and the pusher 20, i.e., the relative movement of the command lever 18 and the pusher 20 in accordance with the positional displacement of the pusher 20 becomes smoother, and the impact accompanied by the positional displacement of the pusher 20 becomes smaller. As a result, the detachment of the actuating piece 58 from the magnet 24 is surely prevented, so that mis-weaving is surely prevented. However, the above described two lines may not always be perpendicular to each other.

The magnet 24 is energized while the heald frame corresponding to the working mechanism 10 should be moved upwards (during the period of one weft inserting in the illustrated embodiment). When the holding force of the magnet 24 is large, the actuating piece 58 is held on the magnet 24 by energizing the magnet 24, so that the knife hooks 16 can be displaced to the position where they can be engaged with the connection hooks 14.

In general, the dobby is provided with a plurality of working mechanisms 10. Therefore, when a magnet with a large holding force is used, the actuating piece in a working mechanism which is not required to upwardly move the heald frames is influenced by the holding force of the magnet in the neighboring working mechanism, and as a result, the movement of the heald frames cannot be controlled correctly.

In order to prevent the above problem, the dobby also comprises a first drive mechanism 66 for periodically moving the command lever 22 in synchronization with the rotation of the main shaft in the weaving machine so that the actuating piece 58 may approach and preferably may be brought into contact with the magnet 24.

Figure 3:
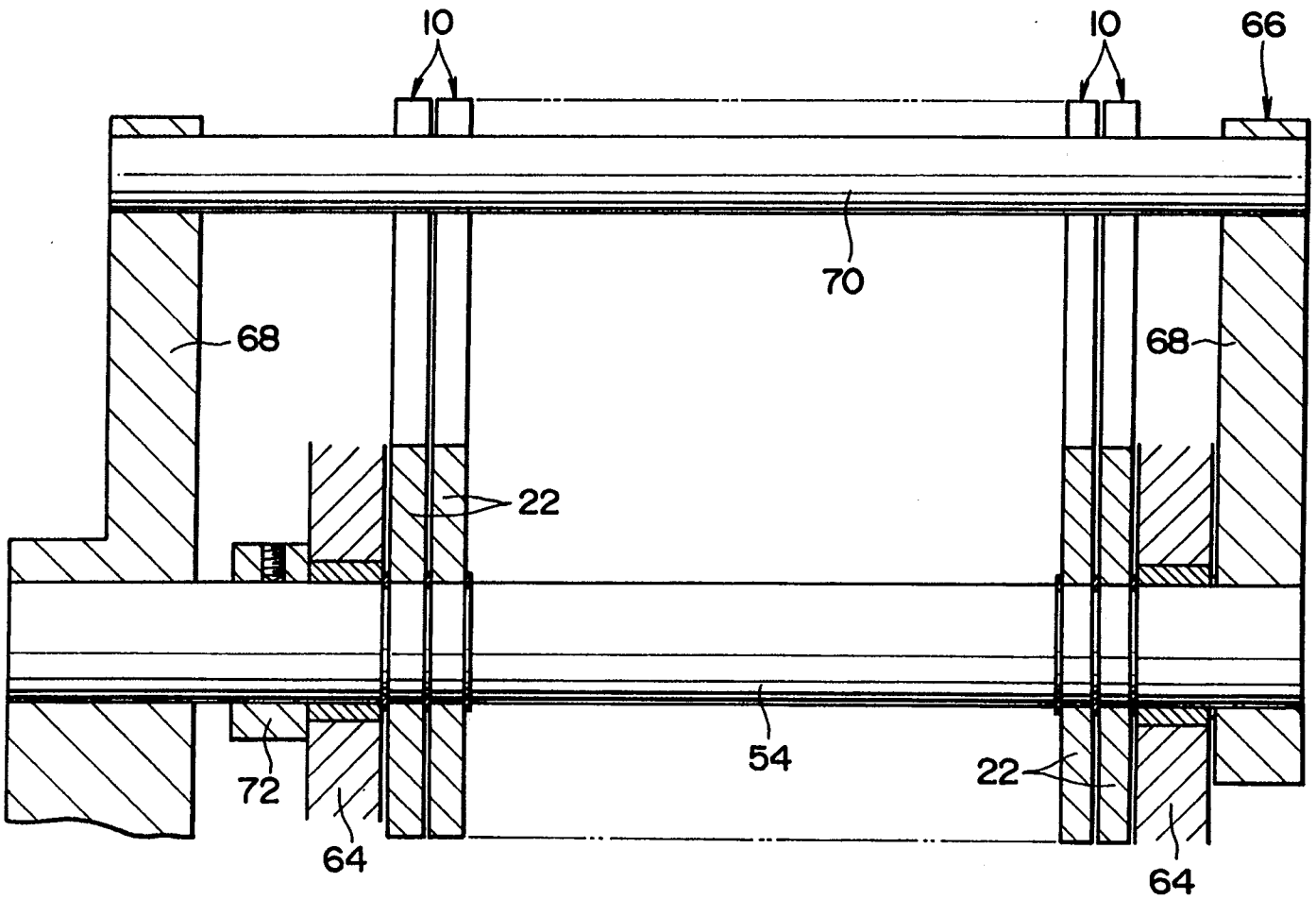
FIG. 3 is an enlarged-scale sectional view taken along a line 3—3 of FIG. 1.

As shown in FIG. 3, the first drive mechanism 66 includes a pair of side plates 68 immovably supported by a pivot 54, a rod 70 for connecting the side plates with each other at the edges, and a stop ring 72 for preventing the pivot 54 from slipping out of a frame 64. One side plate 68 is rocked in synchronization with the rotation of the main shaft in the weaving machine and the pivot 54 is rotatably accommodated in the frame 64. Therefore, when one side plate 68 is rocked, the other side plate 68 is similarly rocked.

The first drive mechanism 66 is always displaced to the position where the actuating piece 58 is separated from the magnet 24 by the force of the elastic body 60. However, at the time corresponding to the starting time when the magnet is energized, the first drive mechanism 66 is displaced for a certain time to the position where the actuating piece 58 is allowed to be brought into contact with the magnet 24 against the force of the elastic body 60. The actuating piece 58 is held on the magnet 24 when the magnet 24 is energized while the actuating piece 58 is brought into contact with the magnet 24.

By use of the first drive mechanism 66 in this manner, even though a magnet having a small holding force is used, the actuating piece 58 is surely held on the magnet 24, and the actuating piece corresponding to a de-energized magnet is not influenced by the holding force of the other energized magnet. As a result, the movement of the heald frames can be controlled correctly.

Since the contact portion 56 of the pusher 20 is always brought into contact with the cam-shaped contact face 50 of the command lever 18 as described above, there is little impact when the pusher 20 is moved to the command lever 18. Therefore, even though a magnet having a small holding force is used, there is no possibility for the actuating piece held on a magnet to separate from the magnet.

When the mis-weaving such as weft mis-inserting occurs in a weaving machine, the weaving machine is stopped once. The process for removing the mis-woven part such as weft removal is done and subsequently the normal rotation is restarted. Since one or more weft insertings are done during the period from the occurrence of such a mis-weaving until the time when the weaving machine stops, the process for such a mis-weaving is performed by removing one or more wefts while rotating the weaving machine reversely.

For processing such a mis-weaving, the dobby further comprises a second drive mechanism 74 for compelling the actuating piece 58 to be brought into contact with the magnet 24 for a certain period of time, when the weaving machine is reversely rotated and then when the weaving machine is normally rotated. The second drive mechanism 74 is a cylinder mechanism mounted on the frame of the dobby and pushes the selection lever 22 toward the magnet 24 for a certain period of time at the start time of the reverse rotation of the weaving machine and at the restart time of the normal rotation of the weaving machine. An electric motor-operated drive mechanism, a solenoid mechanism, a manually operated drive mechanism or the like may also be used as a drive source in the second drive mechanism 74.

Referring now to FIG. 4, the operation for the working mechanisms 10 will be explained as follows.

In FIG. 4, 180 and 360 indicate the angle of rotation of the main shaft in a weaving machine, and the numerals in the parentheses indicate the number of weft inserting times. The numerals 80 and 82 indicate the right-directional and left-directional positions (in FIG. 1) of upper and lower knife hooks which are the knife hooks 16 on the upper side and on the lower side in FIG. 1, respectively.

Figures 4A, 4B, 4C, 4D, 4E, 4F, 4G, 4H:
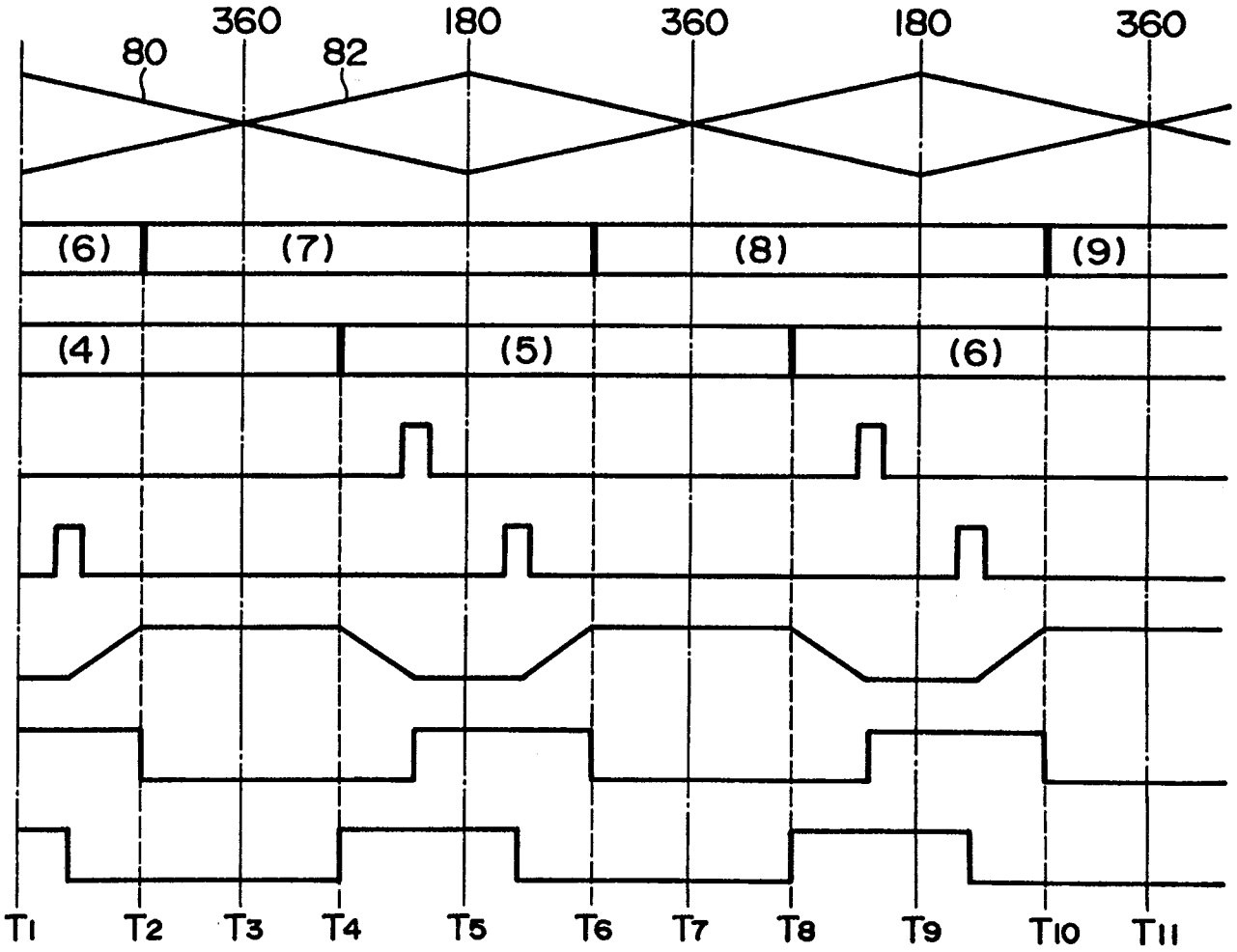
FIG. 4(A) shows the positions of the upper and lower knife hooks in the right and left directions in FIG. 1.
FIG. 4(B) shows the command signal during normal rotation of the weaving machine.
FIG. 4(C) shows the command signal during reverse rotation of the weaving machine.
FIG. 4(D) shows the time period during normal rotation in which a weaving machine having the claimed dobby should not be reversely rotated to process a misweaving.
FIG. 4(E) shows the time period during reverse rotation in which a weaving machine having the claimed dobby should not be rotated in the normal direction to process a misweaving.
FIG. 4(F) shows the position of the actuating piece in relation to the magnet.
FIG. 4(G) shows the time period during normal rotation in which a weaving machine of the prior art should not be reversely rotated to process a misweaving.
FIG. 4(H) shows the time period during reverse rotation in which a weaving machine of the prior art should not be rotated in the normal direction to process a misweaving.

FIG. 4(A) shows the positions of the upper and lower knife hooks in the right and left directions in FIG. 1. The uppermost and lowermost positions in FIG. 4(A) correspond to the positions where the corresponding knife hooks are drawn to the right and returned to the left in accordance with the rocking motion of the rocking lever 38, respectively.

FIG. 4(B) shows the command signal which determines whether the magnet 24 is energized or not and which is shown at each weft inserting when the weaving machine is normally rotated.

FIG. 4(C) shows the command signal which determines whether the magnet 24 is energized or not and which is shown at each weft inserting when the weaving machine is reversely rotated due to the mis-weaving.

FIG. 4(D) shows the period during which there should not be a changeover of the weaving machine from the normal rotation to the reverse rotation (forbidden band against reverse rotation).

FIG. 4(E) shows the period during which there should not be a changeover of the weaving machine from the reverse rotation to the normal rotation (forbidden time period for normal rotation).

FIG. 4(F) shows the position of the actuating piece 58 to the magnet 24. In FIG. 4(F), the higher level shows the period when the actuating piece 58 approaches or is brought into contact with the magnet 24 by the first drive mechanism 66, and the lower level shows the period when the actuating piece 58 is separated from the magnet 24, respectively.

FIG. 4(G) shows a forbidden time period for the reverse rotation of a dobby in the prior art.

FIG. 4(H) shows a forbidden time period for the normal rotation of a dobby in the prior art.

In FIGS. 4(B) and 4(C), the reason why the number of times for weft inserting in the command signal is different at the normal rotation and at the reverse rotation is due to the time difference between the time when the magnet is actually energized and the time when a weft is actually inserted.

When the weaving machine and the dobby are normally driven, the upper knife hook is moved to the left for the period of time from a time T1 until a time T5, to the right for the period of time from the time T5 until a time T9, and to the left for the period of time from the time T9 until a subsequent predetermined time. On the other hand, the lower knife hook is moved reversely to the upper knife hook. The actuating piece 58 approaches or is brought into contact with the magnet 24 by the first drive mechanism 66 for the periods of time from the time T2 until the time T4, from the time T6 until the time T8, and from a time T10 until a subsequent predetermined time, respectively.

When the weaving machine is normally rotated, the control for energizing the magnet 24 is done by use of the command signal shown in FIG. 4(B).

Therefore, assuming the command signal for the 7th weft inserting shown in FIG. 4(B) to be a command for energizing the magnet 24, the magnet 24 is energized during the period of time from the time T2 until the time T6. In this way, the actuating piece 58 is held on the magnet 24 and each of the upper and lower knife hooks is maintained at the position where each knife hook can be engaged with the connection hook 14 during the period of time from the time T2 until the time T6. As a result, the connection hook 14 corresponding to the upper knife hook is moved to the left, if it is engaged with the upper knife hook, whereas the connection hook 14 corresponding to the lower knife hook is moved to the right.

However, when the command signal for the 7th weft inserting shown in FIG. 4(B) is not a command for energizing the magnet 24, the actuating piece 58 is separated from the magnet 24 at the time T4, and therefore, the upper and lower knife hooks are returned to the positions where these knife hooks cannot be engaged with the corresponding connection hooks. As a result, the upper and lower hooks are moved in accordance with the rocking motion of the rocking lever 38, while the connection hooks are not moved.

When a mis-weaving occurs at the time of the normal rotation of a weaving machine, the weaving machine is stopped after one or more weft insertings are done. Subsequently, the weaving machine is reversely rotated so as to treat the mis-weaving.

At the time of reverse rotation, the operation of the actuating piece and the upper and lower knife hooks is reverse to the operation thereof at the time of the normal rotation. For example, assuming the start time of the reverse rotation to be the time T9, the upper knife hook is moved to the left during the period corresponding to the time from the time T9 until the time T5 and to the right for the period corresponding to the time from the time T5 until the time T1. On the other hand, the movement of the lower knife hook is reverse to the movement of the upper knife hook. The actuating piece 58 approaches or is brought into contact with the magnet 24 by the first drive mechanism 66 for the periods corresponding to the time from the time T8 until the time T6 and the time from the time T4 until the time T2, respectively.

However, at the time of the reverse rotation, the control for energizing the magnet 24 is carried out by use of the command signal shown in FIG. 4(C). Therefore, at the time T9 as a start time of the reverse rotation, the actuating piece 58 does not approach or is not brought into contact with the magnet 24. Even though the command signal for the 6th weft inserting is a signal for commanding to energize the magnet, the upper and lower knife hooks are not displaced to the position where these knife hooks can be engaged with the connection hooks, so that the connection hooks cannot be drawn to the right.

As a result, the corresponding heald frame is not moved upward and a weaving pattern for the 6th weft inserting, i.e., shedding pattern is not reproduced, so that the removal of the weft in the 6th weft inserting becomes difficult. The problem described above occurs not merely at the start time of the reverse rotation but also at the restart time of the normal rotation.

In order to solve the above problem, as shown in FIGS. 4(G) and 4(H), relatively large forbidden periods for the reverse and normal rotations had to be provided in case of the prior dobby.

On the other hand, according to the dobby provided with the second drive mechanism 74, the actuating piece 58 approaches or is brought into contact with the magnet 24 at the start time of the reverse rotation and at the restart time of the normal rotation. Therefore, even when the start time of the reverse rotation and the restart time of the normal rotation happen to be the time when the actuating piece 58 does not approach or is not brought into contact with the magnet 24 by the first drive mechanism 66, the weaving pattern at that time can be reproduced.

As shown in FIGS. 4(C) and 4(D), according to the dobby provided with the second drive mechanism 74, the forbidden band against the reverse rotation and that against the normal rotation can be minimized depending on mechanical processing errors or the like, and a sufficient time to the weft inserting is resulted.

The present invention can be applied to not only a double acting dobby for rocking the vertical lever 12 by a pair of knife hooks 16 as shown in the above preferred embodiments, but also other types of dobbies such as a dobby for rocking the vertical lever 12 by one knife hook 16, a dobby for periodically moving each connection hook 14 in the direction of approaching or leaving each knife hook 16.

Figure 5:
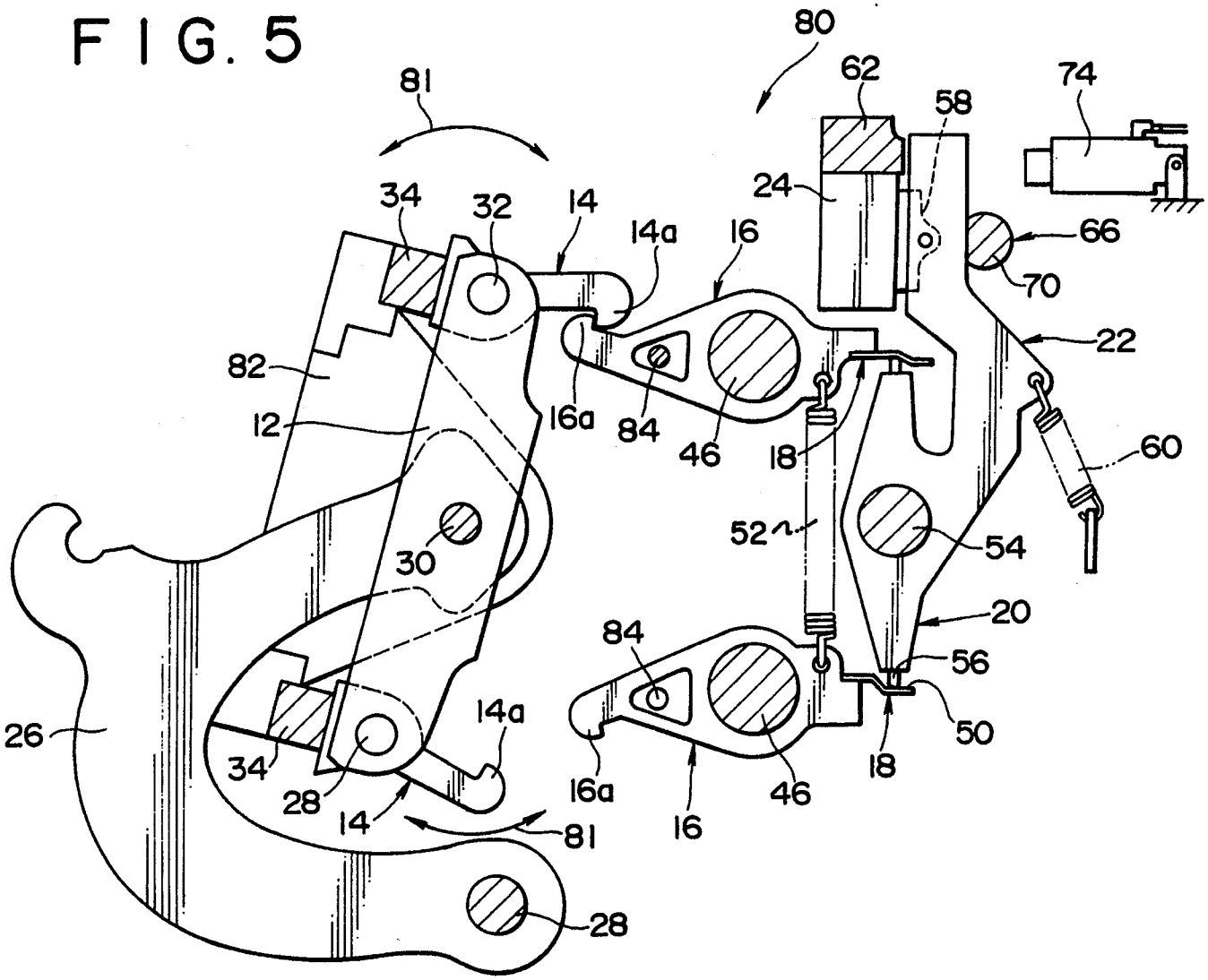
FIG. 5 is a view showing a dobby as another preferred embodiment of the present invention.

A working mechanism 80 of a dobby shown in FIG. 5 periodically moves the connection hooks 14 and the stoppers 34 in the direction of approaching or leaving the knife hooks 16 as indicated by an arrow 81 in the drawing. Both stoppers 34 are supported by an elongated member 82 supported by the pivot 30. Each knife hook 16 is supported by an immovable pivot 46 rockably in the right or left direction in the drawing and the range of the pivot motion is limited by another stopper 84. The working mechanism of this type is described, e.g., in Japanese Pat. Publication No. 2-23611.

Each command lever 18 in the working mechanism 80 is fixed to the knife hook 16 by a bolt or the like. Although not shown by a symbol, each contact face 50 has flat first and second faces 50*a* and 50*c* and an inclined third face 50*b* extending to the first and second faces, similarly to the preferred embodiment shown in FIG. 2. In case of the working mechanism 80, each command lever 18 and each knife hook 16 may be provided integrally, namely the contact face 50 of each command lever 18 may be formed on the knife hook 16.

In the above preferred embodiment, the vertical direction in FIG. 1 has been explained as the vertical direction of the actual weaving machine. In the present invention, the right or left direction in FIGS. 1 and 5 may also be used so as to be the vertical direction of the actual weaving machine.

The first and second drive mechanisms 66 and 74 may also be provided at each working mechanism 10, and the first and second drive mechanisms 66 and 74 may also be used in common for all working mechanisms or a plurality of working mechanisms.

Furthermore, the function of the second drive mechanism may also be added to the function of the first drive mechanism. In this case, a drive source just like a cylinder mechanism may be used as a drive source as the first drive mechanism. The first drive mechanism is not merely operated in synchronization with the rotation of the main shaft in the weaving machine, but also may be operated at the start time of the reverse rotation and subsequently at the restart time of the normal rotation.

What is claimed is:

1. A dobby comprising:

first and second hooks with means for moving at least one of said first and second hooks in the direction of approaching and leaving each other, said first hook being connected to a heald frame, said second hook being pivotally movable to a first position where said second hook cannot be engaged with said first hook and to a second position where said second hook can be engaged with said first hook;

a first lever selectively displaceable to a third position for controlling said second hook to be pivotally displaced to said first position and to a fourth position for controlling said second hook to be pivotally displaced to said second position;

a pusher selectively displaceable to a fifth position for controlling said first lever to be displaced to said third position and to a sixth position for controlling said first lever to be displaced to said fourth position;

a second lever for selectively displacing said pusher to said fifth and sixth positions; and a magnet for releasably holding said second lever so as to maintain said pusher at one of said fifth and sixth positions;

a cam-shaped contact face on one of said first lever and pusher; and means for continuously contacting said cam-shaped contact face on a part of the other of said first lever and said pusher.

2. A dobby according to claim 1, wherein said contact face has flat first and second faces and an inclined third face extending between said first and second faces so as to be continuous with said first and second faces.

3. A dobby according to claim 1, wherein a line for connecting a contact portion between said first lever and said pusher to a rocking motion center of said first lever is perpendicular to a line for connecting said contact portion between said first lever and said pusher to a rocking motion center of said pusher.

4. A dobby according to claim 1, wherein said second lever maintains said pusher at said sixth position when said second lever is held on said magnet.

5. A dobby according to claim 1, further including an elastic body for applying a force to said second lever, which allows said pusher to be displaced to the other of said fifth and sixth positions.

6. A dobby according to claim 1, wherein said means for moving at least one of said first hook and second hook comprises means for reciprocably moving said first hook in the direction of approaching and leaving said second hook and means for reciprocably moving said second hook periodically in the direction of approaching and leaving said first hook.

7. A dobby according to claim 6, further including an elastic body for applying a force to said second hook, which allows said second hook to be displaced to one of said first and second positions, and wherein said means for continuously contacting said cam-shaped contact face on a part of the other of said first lever and said pusher comprises another elastic body for applying a force to said first lever, which allows said first lever to be displaced to said third position.

8. A dobby according to claim 1, wherein said for moving at least one of said first hook and second hook comprises means for reciprocably moving said first hook periodically in the direction of approaching and leaving said second hook, and means for supporting said second hook so that it is immovable in the direction of approaching and leaving said first hook.

9. A dobby according to claim 8, wherein said first lever is fixed to said second hook.

10. A dobby according to claim 8, wherein said means for continuously contacting said cam-shaped contact face on a part of the other of said first lever and said pusher comprises an elastic body for applying a force to said second hook to displace said second hook to either one of said first and second positions.

11. A dobby according to claim 1, further including:

a pair of said first hooks pivotally attached to a rockable third lever and provided at an opposite position with respect to a rocking motion center of said third lever;

a pair of said second hooks, each second hook corresponding to one of said first hooks and capable of being engaged with its corresponding first hook; and a pair of said first levers, each first lever corresponding to one of said second hooks and controlling its corresponding second hook;

wherein said pusher controls both of said first levers.

12. A dobby according to claim 1, further including drive means for moving said second lever toward said magnet periodically in synchronization with the rotation of a main shaft in a weaving machine, said second lever moved toward said magnet at the start times of the reverse and normal rotations of the main shaft in said weaving machine.

13. A dobby according to claim 12, wherein said drive means includes a first drive mechanism for periodically moving said second lever toward said magnet in synchronization with the rotation of the main shaft in the weaving machine, and a second drive mechanism for moving said second lever toward said magnet at the start time of the reverse rotation and at the restart time of the normal rotation of the main shaft in said weaving machine.

14. A dobby comprising:

first and second hooks with means for moving at least one of said first and second hooks in the direction of approaching and leaving each other, said first hook being connected to a heald frame, said second hook being pivotally movable to a first position where said second hook cannot be engaged with said first hook and a second position where said second hook can be engaged with said first hook;

a first lever selectively displaceable to a third position for controlling said second hook to be pivotally displaced to said first position and to a fourth position for controlling said second hook to be pivotally displaced to said second position;

a pusher selectively displaceable to a fifth position for controlling said first lever to be displaced to said third position and to a sixth position for controlling said first lever to be displaced to said fourth position;

a second lever for selectively displacing said pusher to said fifth and sixth positions; and a magnet for releasably holding said second lever so as to maintain said pusher at one of said fifth and sixth positions;

wherein one of said first lever and said pusher has a cam-shaped contact face brought into contact with a part of the other of said first lever and said pusher, said contact face having flat first and second faces and an inclined third face extending between said first and second faces so as to be continuous with said first and second faces.

15. A dobby comprising:

first and second hooks with means for moving at least one of said first and second hooks in the direction of approaching and leaving each other, said first hook being connected to a heald frame, said second hook being pivotally movable to a first position where said second hook cannot be engaged with said first hook and a second position where said second hook can be engaged with said first hook;

a first lever selectively displaceable to a third position for controlling said second hook to be pivotally displaced to said first position and to a fourth position for controlling said second hook to be pivotally displaced to said second position;

a pusher selectively displaceable to a fifth position for controlling said first lever to be displaced to said third position and to a sixth position for controlling said first lever to be displaced to said fourth position;

a second lever for selectively displacing said pusher to said fifth and sixth positions; and a magnet for releasably holding said second lever so as to maintain said pusher at one of said fifth and sixth positions;

wherein one of said first lever and said pusher has a cam-shaped contact face brought into contact with a part of the other of said first lever and said pusher, and a line for connecting a contact portion between said first lever and said pusher to a rocking motion center of said first lever is perpendicular to a line for connecting said contact portion between said first lever and said pusher to a rocking motion center of said pusher.

16. A dobby comprising:

first and second hooks with means for moving at least one of said first and second hooks in the direction of approaching and leaving each other, said first hook being connected to a heald frame, said second hook being pivotally movable to a first position where said second hook cannot be engaged with said first hook and a second position where said second hook can be engaged with said first hook;

a first lever selectively displaceable to a third position for controlling said second hook to be pivotally displaced to said first position and to a fourth position for controlling said second hook to be pivotally displaced to said second position;

a pusher selectively displaceable to a fifth position for controlling said first lever to be displaced to said third position and to a sixth position for controlling said first lever to be displaced to said fourth position;

a second lever for selectively displacing said pusher to said fifth and sixth positions;

a magnet for releasably holding said second lever so as to maintain said pusher at one of said fifth and sixth positions, wherein one of said first lever and said pusher has a cam-shaped contact face brought into contact with a part of the other of said first lever and said pusher; and drive means for moving said second lever toward said magnet periodically in synchronization with the rotation of a main shaft in a weaving machine, said second lever moved toward said magnet at the start times of the reverse and normal rotations of the main shaft in said weaving machine.

17. A dobby according to claim 16, wherein said drive means includes a first drive mechanism for periodically moving said second lever toward said magnet in synchronization with the rotation of the main shaft in the weaving machine, and a second drive mechanism for moving said second lever toward said magnet at the start time of the reverse rotation and at the restart time of the normal rotation of the main shaft in said weaving machine.

* * * * *

UNITED STATES PATENT AND TRADEMARK OFFICE

CERTIFICATE OF CORRECTION

PATENT NO. : 5,365,979

DATED : November 22, 1994

INVENTOR(S) : Fumio Yoshida

It is certified that error appears in the above-indentified patent and that said Letters Patent is hereby corrected as shown below:

Column 1 Line 15 "frame:" should read --frame;--.

Claim 1 Line 30 Column 13 "and pusher;" should read --and said pusher;--.

Claim 8 Line 1 Column 14 after "said" insert --means--.

Signed and Sealed this

Twenty-first Day of February, 1995

*Attest:*

*Attesting Officer*

BRUCE LEHMAN

*Commissioner of Patents and Trademarks*